US009527696B2

(12) United States Patent
Mitsuda

(10) Patent No.: US 9,527,696 B2
(45) Date of Patent: Dec. 27, 2016

(54) ELEVATOR GROUP CONTROL SYSTEM FOR DOUBLE OPERATION

(75) Inventor: Masayuki Mitsuda, Aichi (JP)

(73) Assignee: Mitsubishi Electric Corporation, Tokyo (JP)

( * ) Notice: Subject to any disclaimer, the term of this patent is extended or adjusted under 35 U.S.C. 154(b) by 630 days.

(21) Appl. No.: 14/110,861

(22) PCT Filed: Apr. 14, 2011

(86) PCT No.: PCT/JP2011/059233

§ 371 (c)(1),
(2), (4) Date: Jan. 22, 2014

(87) PCT Pub. No.: WO2012/140758

PCT Pub. Date: Oct. 18, 2012

(65) Prior Publication Data

US 2014/0216858 A1 Aug. 7, 2014

(51) Int. Cl.
*B66B 1/18* (2006.01)
*B66B 1/24* (2006.01)

(52) U.S. Cl.
CPC ..... *B66B 1/2408* (2013.01); *B66B 1/2433* (2013.01); *B66B 2201/103* (2013.01); *B66B 2201/306* (2013.01)

(58) Field of Classification Search
CPC ..... B66B 1/2408; B66B 1/2433; B66B 2201/103; B66B 2201/306
USPC ..... 187/247, 249, 380–389, 391, 393, 902
See application file for complete search history.

(56) References Cited

U.S. PATENT DOCUMENTS 5,086,883 A * 2/1992 Schroder ..... B66B 1/2458 187/258
5,844,179 A * 12/1998 Walker ..... B66B 1/2416 187/382
5,861,587 A * 1/1999 Powell ..... B66B 1/2416 187/249

(Continued)

FOREIGN PATENT DOCUMENTS

JP 61 248875 11/1986
JP 5 162927 6/1993

(Continued)

OTHER PUBLICATIONS

Extended European Search Report issued on Aug. 27, 2014 in the corresponding European Application No. 11863527.5.

(Continued)

*Primary Examiner* — Anthony Salata
(74) *Attorney, Agent, or Firm* — Oblon, McClelland, Maier & Neustadt, L.L.P.

(57) ABSTRACT

An elevator group control system, which can perform an appropriate operation so that a user can shorten the time spent until the user arrives at a destination floor in a double-deck elevator performing a double operation in at least one running direction, including a hall operating panel by use of which a user inputs a destination floor in a prescribed hall of an elevator. In a case an operation-prohibited floor of a car stopping at the hall is inputted as a destination floor from the hall operating panel, a group control device registers, as a service floor of the car, a floor preceding or beyond the destination floor inputted from the hall operating panel.

8 Claims, 9 Drawing Sheets

(56) References Cited

U.S. PATENT DOCUMENTS

| | | | | |
|---|---|---|---|---|
| 6,176,351 | B1 * | 1/2001 | Ikeda | B66B 1/2458 187/387 |
| 6,237,721 | B1 * | 5/2001 | Siikonen | B66B 1/2458 187/382 |
| 6,505,712 | B2 * | 1/2003 | Hattori | B66B 1/2458 187/382 |
| 6,508,333 | B2 * | 1/2003 | Kostka | B66B 1/2458 187/382 |
| 7,108,106 | B2 * | 9/2006 | Kostka | B66B 1/2416 187/391 |
| 7,377,365 | B2 * | 5/2008 | Abe | B66B 1/2416 187/396 |
| 8,387,756 | B2 * | 3/2013 | Laihanen | B66B 1/2458 187/387 |
| 8,978,833 | B2 * | 3/2015 | Suzuki | B66B 1/2458 187/382 |
| 2014/0041968 | A1 * | 2/2014 | Tokura | B66B 1/2458 187/389 |

FOREIGN PATENT DOCUMENTS

| | | |
|---|---|---|
| JP | 6 040671 | 2/1994 |
| JP | 07 309539 | 11/1995 |
| JP | 8 231140 | 9/1996 |
| JP | 2004 203508 | 7/2004 |
| JP | 2004 307123 | 11/2004 |
| JP | 2005 200181 | 7/2005 |
| WO | 2006 117918 | 11/2006 |

OTHER PUBLICATIONS

English Translation of the International Preliminary Report on Patentability issued Oct. 24, 2013 in PCT/JP2011/059233.

International Search Report Issued Dec. 6, 2011 in PCT/JP11/059233 Filed Apr. 14, 2011.

* cited by examiner

No. 9: TRANSIENT FLOOR DETERMINATION MEANS

Fig. 3

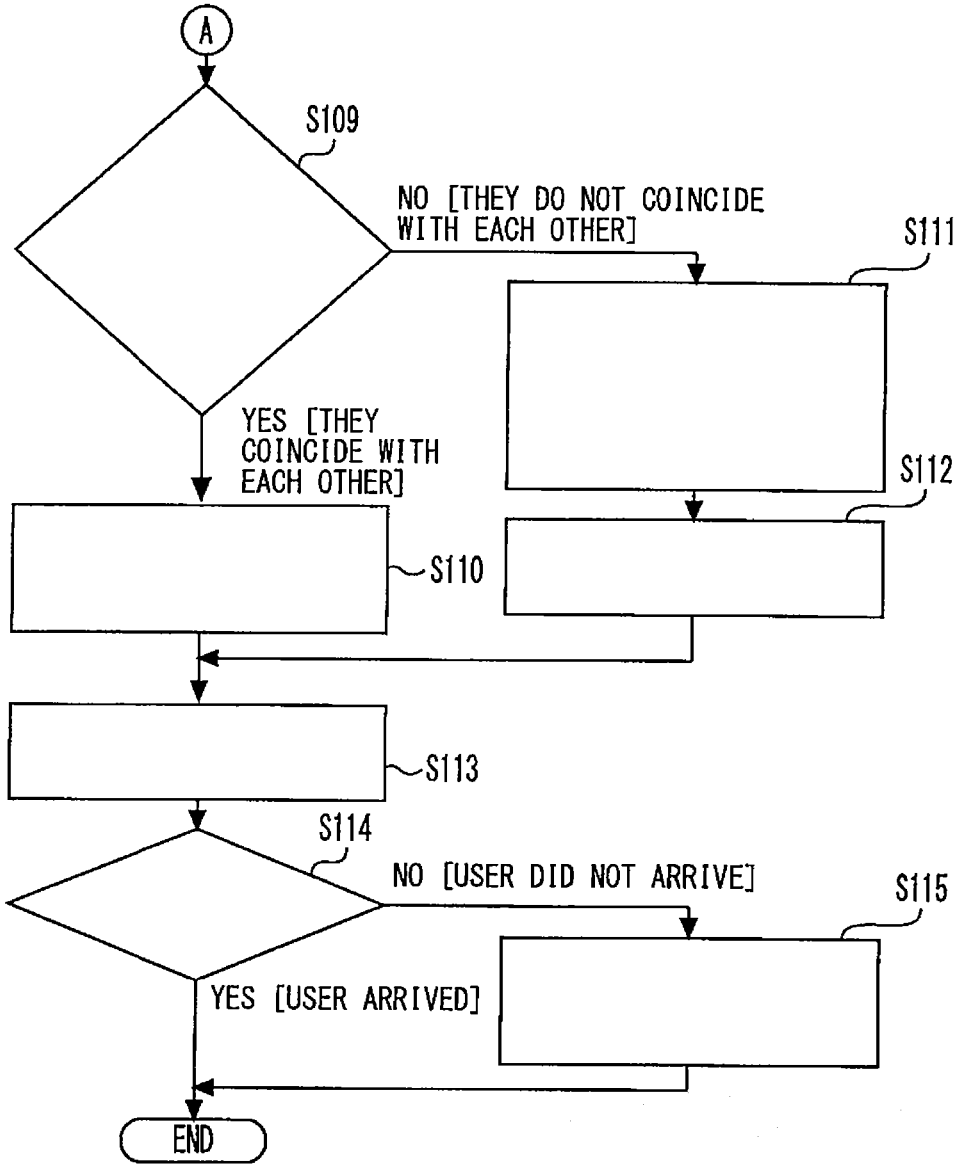

S109: DO DESTINATION FLOOR INFORMATION STORED IN DESTINATION FLOOR STORAGE MEANS AND SERVICE FLOOR INFORMATION INPUTTED FROM GROUP CONTROL DEVICE COINCIDE WITH EACH OTHER?
S110: INDICATOR OF HALL OPERATING PANEL INDICATES EACH OF INFORMATION ON SERVICE FLOOR, ASSIGNED CAR, AND UPPER OR LOWER CAR
S111: INDICATOR OF HALL OPERATING PANEL INDICATES EACH OF INFORMATION ON SERVICE FLOOR, ASSIGNED CAR, AND UPPER OR LOWER CAR AS WELL AS MAP INFORMATION STORED IN MAP STORAGE DEVICE
S112: MAKE ANNOUNCEMENT CORRESPONDING TO MAP INFORMATION
S113: USER BOARDS CAR AND MOVES TO SERVICE FLOOR
S114: COULD USER ARRIVE AT DESTINATION FLOOR?
S115: USER MOVES TO DESTINATION FLOOR IN ACCORDANCE WITH MAP INFORMATION INDICATED IN INDICATOR

Fig. 4

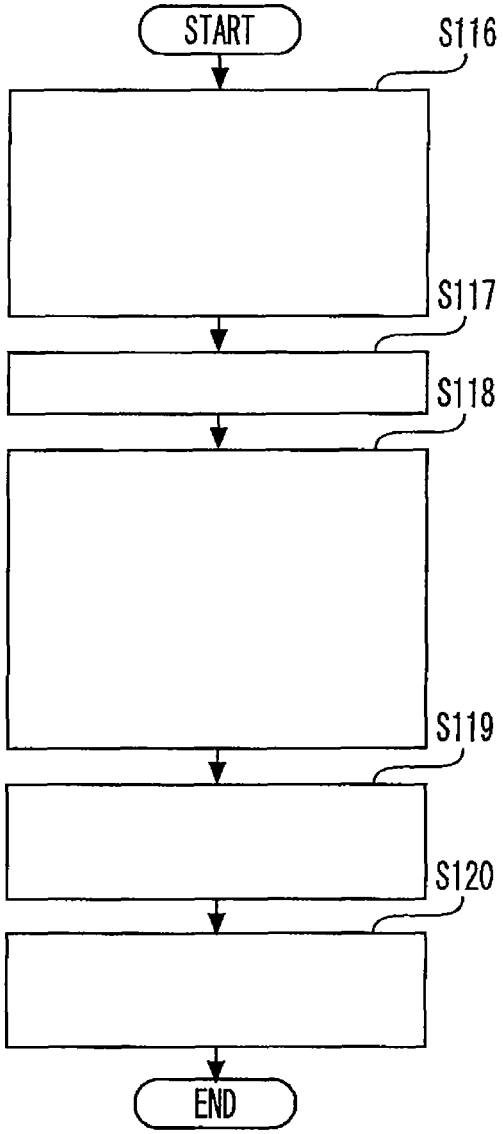

S116: GROUP CONTROL DEVICE SENDS ASSIGNED CAR INFORMATION, UPPER OR LOWER CAR INFORMATION, SERVICE FLOOR INFORMATION, BOARDING FLOOR INFORMATION, AND SERVICE FLOOR INFORMATION BEFORE CHANGE TO CAR CONTROL DEVICE

S117: PERFORM OPERATION OF CAR DEVICE

S118: WHEN IT IS DECIDED THAT ASSIGNED CAR ARRIVES AT SERVICE FLOOR, ON THE BASIS OF SERVICE FLOOR BEFORE AND AFTER CHANGE, MAP INFORMATION IS OBTAINED FROM MAP STORAGE DEVICE AND CORRESPONDING VOICE INFORMATION IS OBTAINED FROM ANNOUNCEMENT STORAGE DEVICE

S119: MAP INFORMATION IS INDICATED ON INDICATOR

S120: ANNOUNCEMENT IS MADE FROM ANNOUNCEMENT DEVICE

Fig. 5

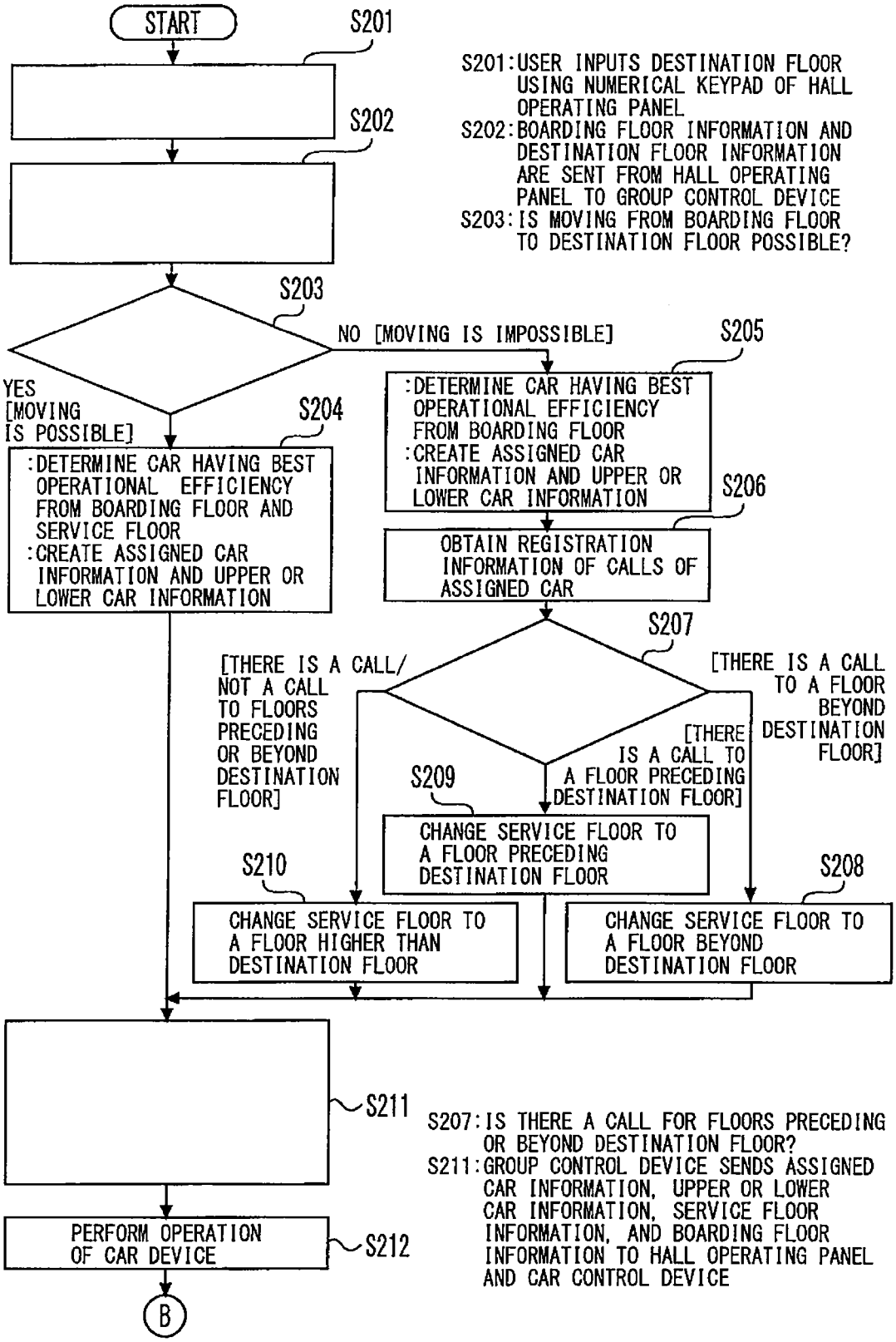

S201: USER INPUTS DESTINATION FLOOR USING NUMERICAL KEYPAD OF HALL OPERATING PANEL
S202: BOARDING FLOOR INFORMATION AND DESTINATION FLOOR INFORMATION ARE SENT FROM HALL OPERATING PANEL TO GROUP CONTROL DEVICE
S203: IS MOVING FROM BOARDING FLOOR TO DESTINATION FLOOR POSSIBLE?

S207: IS THERE A CALL FOR FLOORS PRECEDING OR BEYOND DESTINATION FLOOR?
S211: GROUP CONTROL DEVICE SENDS ASSIGNED CAR INFORMATION, UPPER OR LOWER CAR INFORMATION, SERVICE FLOOR INFORMATION, AND BOARDING FLOOR INFORMATION TO HALL OPERATING PANEL AND CAR CONTROL DEVICE

Fig. 6

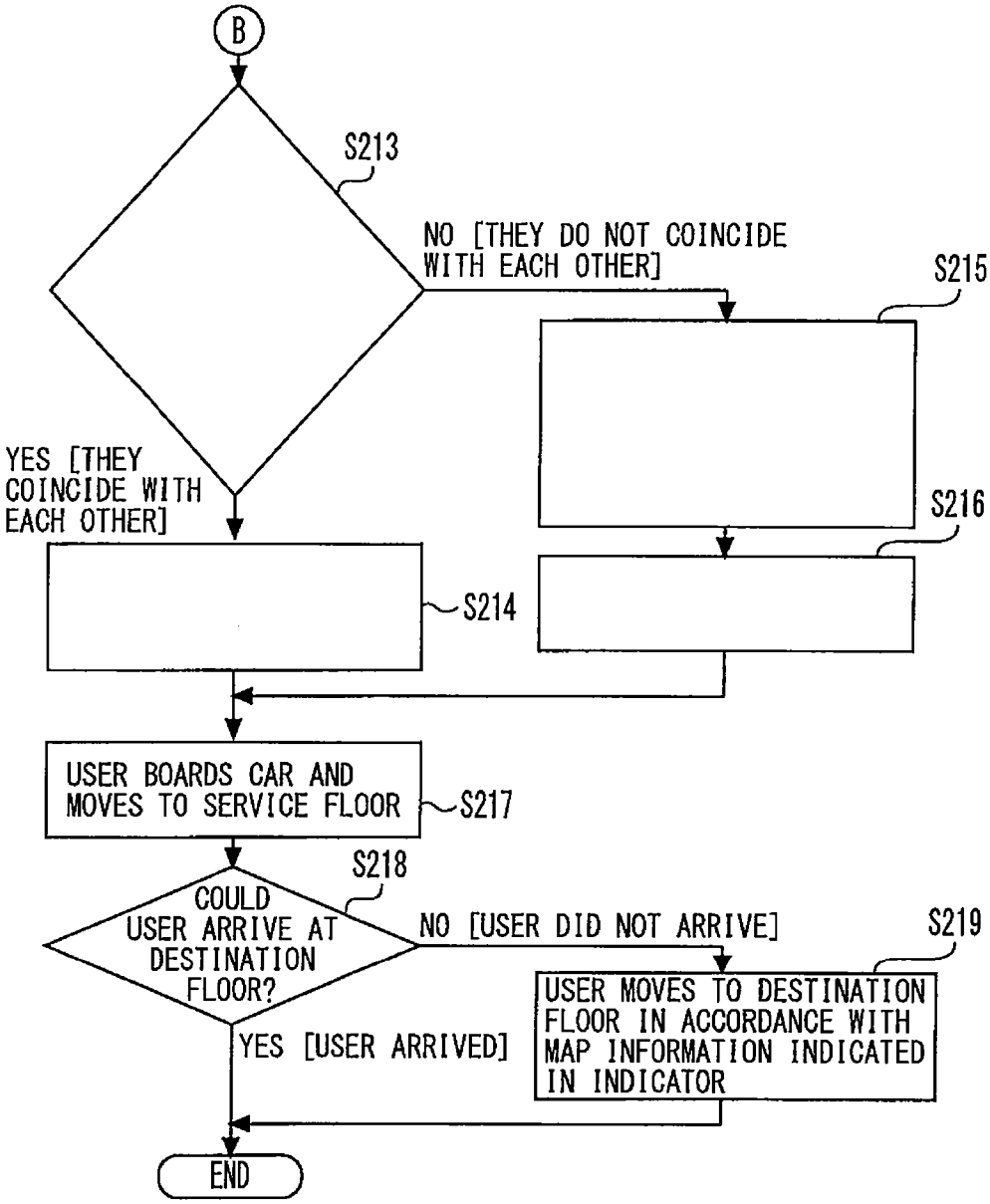

S213: DO DESTINATION FLOOR INFORMATION STORED IN DESTINATION FLOOR STORAGE MEANS AND SERVICE FLOOR INFORMATION INPUTTED FROM GROUP CONTROL DEVICE COINCIDE WITH EACH OTHER?

S214: INDICATOR OF HALL OPERATING PANEL INDICATES EACH OF INFORMATION ON SERVICE FLOOR, ASSIGNED CAR, AND UPPER OR LOWER CAR

S215: INDICATOR OF HALL OPERATING PANEL INDICATES EACH OF INFORMATION ON SERVICE FLOOR, ASSIGNED CAR, AND UPPER OR LOWER CAR AS WELL AS MAP INFORMATION STORED IN MAP STORAGE DEVICE

S216: MAKE ANNOUNCEMENT CORRESPONDING TO MAP INFORMATION

Fig. 7

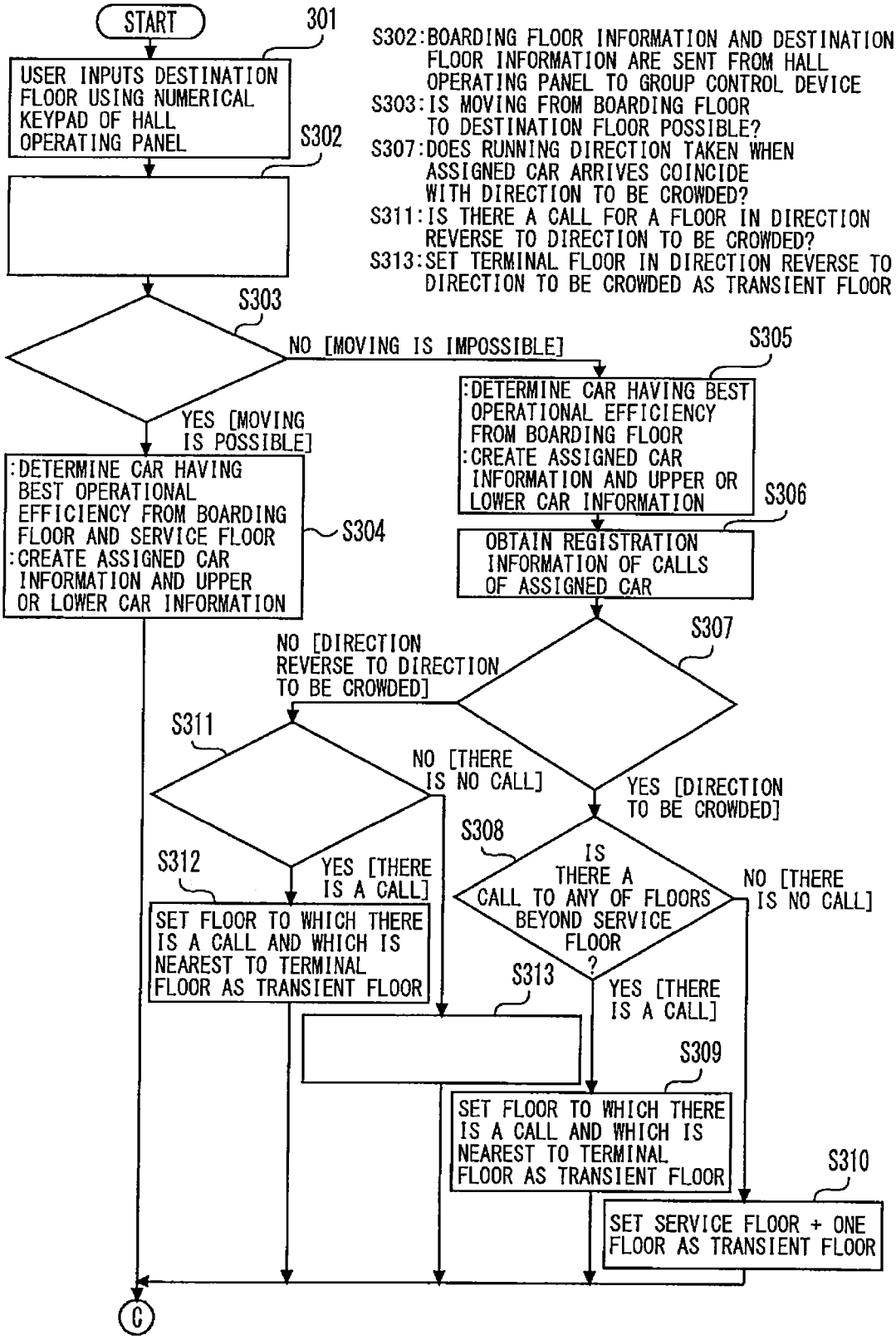

S302: BOARDING FLOOR INFORMATION AND DESTINATION FLOOR INFORMATION ARE SENT FROM HALL OPERATING PANEL TO GROUP CONTROL DEVICE
S303: IS MOVING FROM BOARDING FLOOR TO DESTINATION FLOOR POSSIBLE?
S307: DOES RUNNING DIRECTION TAKEN WHEN ASSIGNED CAR ARRIVES COINCIDE WITH DIRECTION TO BE CROWDED?
S311: IS THERE A CALL FOR A FLOOR IN DIRECTION REVERSE TO DIRECTION TO BE CROWDED?
S313: SET TERMINAL FLOOR IN DIRECTION REVERSE TO DIRECTION TO BE CROWDED AS TRANSIENT FLOOR

ELEVATOR GROUP CONTROL SYSTEM FOR DOUBLE OPERATION

TECHNICAL FIELD

The present invention relates to a group control system which controls the operation of double-deck elevators.

BACKGROUND ART

A double-deck elevator is provided with two cars which are vertically connected to each other. A car arranged above (an upper car) and a car arranged below (a lower car) ascend and descend in a combined manner in a shaft.

For a double-deck elevator, there are operation modes called a double operation and a semi-double operation.

In a double operation, an upper car stops only at either odd-numbered floors or even-numbered floors. A lower car stops only at the other of the odd-numbered floors or even-numbered floors. In the case where a double operation is performed, a user cannot move directly from an odd-numbered floor to an even-numbered floor or from an even-numbered floor to an odd-numbered floor using an elevator.

In a semi-double operation, an upper car stops at both odd-numbered floors and even-numbered floors. Also a lower car stops at both odd-numbered floors and even-numbered floors. In the case where a semi-double operation is performed, a user can move from any floor to any floor (with the exception of the case where a user moves from one terminal floor to the other terminal floor).

Patent Literature 1 below describes a double-deck elevator which performs only a double operation. In the double-deck elevator described in Patent Literature 1, only a destination button for odd-numbered floors is provided in halls of odd-numbered floors and only a destination button for even-numbered floors is provided in halls of even-numbered floors.

In the double-deck elevator described in Patent Literature 1, only a double operation is performed and, therefore, this double-deck elevator provides low convenience. In contrast to this, Patent Literatures 2 and 3 below disclose double-deck elevators which perform both a double operation and a semi-double operation.

The double-deck elevator described in Patent Literature 2, a destination button for each floor is provided in halls. In the case where a double operation is performed, for a destination button for a floor to which a user cannot move directly from a hall, the registration of a call is invalid and information to that effect is indicated by a lamp.

In the double-deck elevator described in Patent Literature 3, a double operation is performed in a prescribed running direction to be crowded and a semi-double operation is performed in the reverse running direction.

CITATION LIST

Patent Literature

Patent Literature 1: Japanese Patent Laid-Open No. 61-248875

Patent Literature 2: Japanese Patent Laid-Open No. 05-162927

Patent Literature 3: Japanese Patent Laid-Open No. 2004-307123

SUMMARY OF INVENTION

Technical Problem

When a service floor indication is performed in a hall as in the double-deck elevator described in Patent Literature 2, users may sometimes give up the use of an elevator. For example, a user who moves from an odd-numbered floor to an even-numbered floor is unwilling to use an elevator performing a double-operation. For this reason, the user spends time in searching for other moving means to a destination floor, with the result that the user sometimes is very late in arriving at the destination floor.

In the double-deck elevator described in Patent Literature 3, in the case where a user wants to move from an odd-numbered floor to an even-numbered floor in the running direction in which a double operation is performed, the user must changes cars once by the time the user arrives at the destination floor. For this reason, as with the double-deck elevator described in Patent Literature 2, also the double-deck elevator described in Patent Literature 3 has the problem that a user is late in arriving at a destination floor.

The present invention was made to solve the problems described above and an object of the present invention is to provide an elevator group control system which can perform an appropriate operation so that a user can shorten the time spent until the user arrives at a destination floor in a double-deck elevator performing a double operation in at least one running direction.

Solution to Problem

An elevator group control system of the invention is a system which is provided with two cars vertically connected to each other and performs a double operation in a prescribed running direction. The elevator group control system comprises a hall operating panel which is provided in a prescribed hall of an elevator and by use of which a user inputs a destination floor, and a group control device which, in the case where an operation-prohibited floor of a car stopping at the hall is inputted from the hall operating panel as a destination floor, registers a floor preceding or beyond the destination floor inputted from the hall operating panel as a service floor of the car.

Also, an elevator group control system of the invention is a system which is provided with two cars vertically connected to each other and performs a double operation in one running direction and performs a semi-double operation in the other running direction. The elevator group control system comprises a hall operating panel which is provided in a prescribed hall of an elevator and by use of which a user inputs a destination floor, a group control device which, in the case where an operation-prohibited floor of a car stopping at the hall is inputted from the hall operating panel as a destination floor, registers the destination floor inputted from the hall operating panel as a service floor of the car and registers a prescribed floor beyond the service floor as a transient floor, and a car control device which, after the registration of the transient floor by the group control device, causes the car to move to the transient floor and thereafter causes the car to stop at the service floor.

Advantageous Effect of Invention

With the elevator group control system of the present invention, it is possible to perform an appropriate operation so that a user can shorten the time spent until the user arrives at a destination floor in a double-deck elevator performing a double operation in at least one running direction.

BRIEF DESCRIPTION OF DRAWINGS

FIG. 3 is a flowchart showing actions of the elevator group control system in the first embodiment according to the present invention.

FIG. 4 is a flowchart showing other actions of the elevator group control system in the first embodiment according to the present invention.

FIG. 5 is a flowchart showing actions of the elevator group control system in a second embodiment according to the present invention.

FIG. 6 is a flowchart showing actions of the elevator group control system in the second embodiment according to the present invention.

FIG. 7 is a flowchart showing actions of the elevator group control system in a third embodiment according to the present invention.

DESCRIPTION OF EMBODIMENTS

The present invention will be described in more detail with reference to the accompanying drawings. Incidentally, in each of the drawings, identical numerals refer to identical or corresponding parts and redundant descriptions of these parts are appropriately simplified or omitted.

First Embodiment

Figure 1:
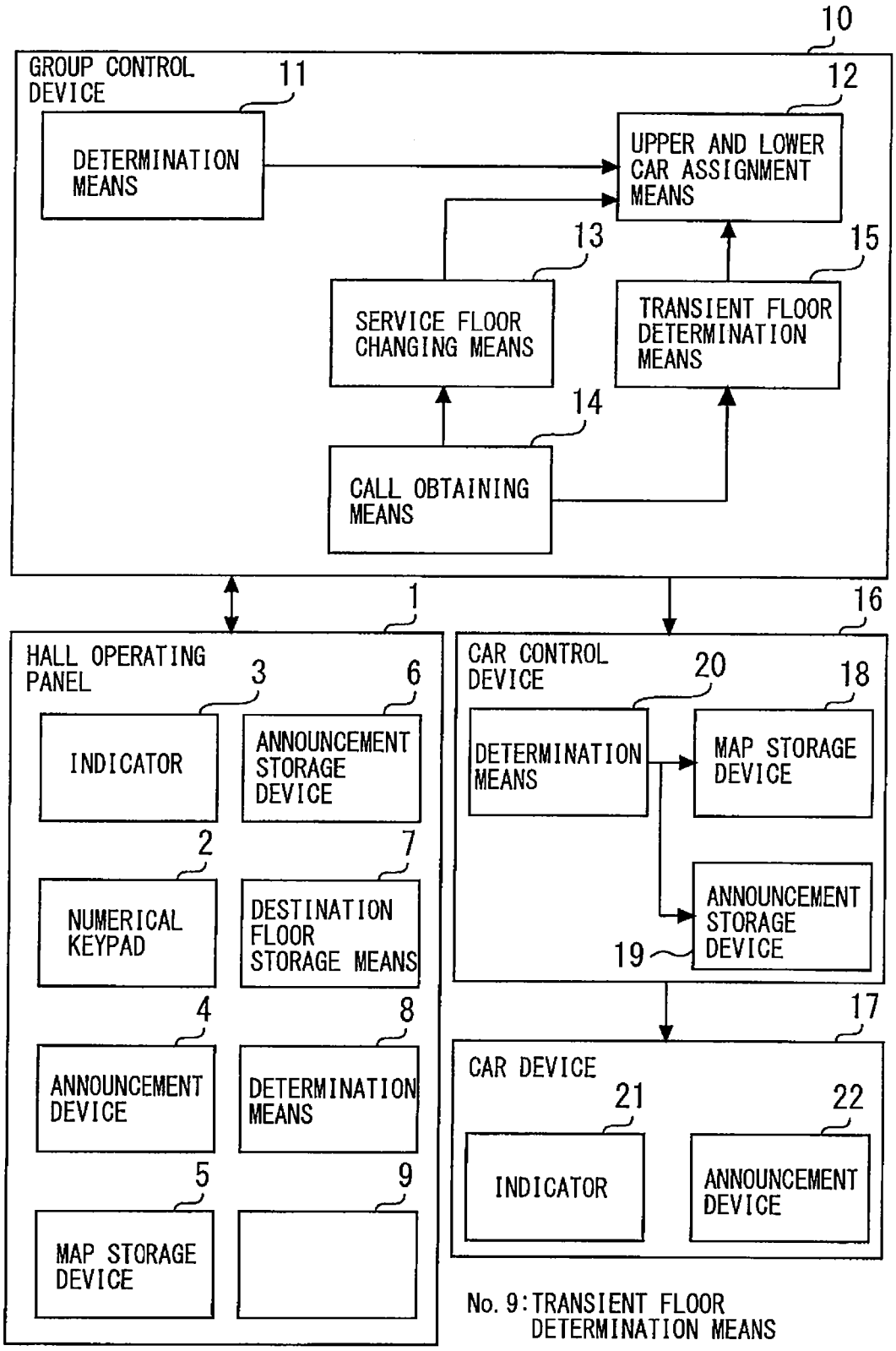
FIG. 1 is a diagram showing the configuration of an elevator group control system in a first embodiment according to the present invention.

FIG. 1 is a diagram showing the configuration of an elevator group control system in a first embodiment according to the present invention.

Figure 9:
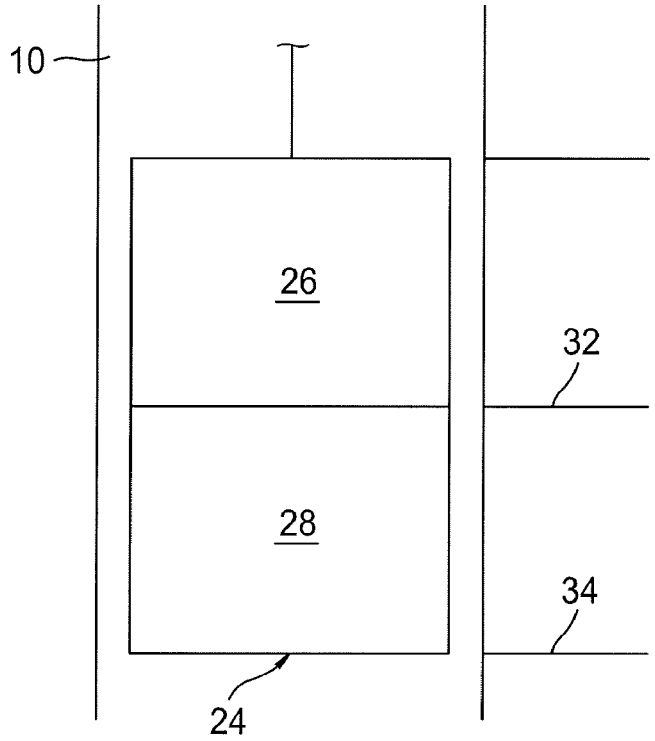
FIG. 9 schematically illustrates an example of double-deck elevators according to the invention.

This group control system controls the operation of double-deck elevators 24 shown in FIG. 9. That is, this group control system is provided with two cars 26 and 28 vertically connected to each other. A car 26 arranged above (an upper car) and a car 28 arranged below (a lower car) ascend and descend in a combined manner in a shaft 10.

In this embodiment, a double operation is performed in at least one running direction. A double operation may be performed only in one running direction and a double operation may be performed in two running directions. In a double operation, an upper car 26 stops only at either odd-numbered floors 32 or even-numbered floors 34. A lower car 28 stops only at the other of the odd-numbered floors 32 or even-numbered floors 34. In a running direction in which a double operation is performed, a user cannot move directly from an odd-numbered floor 32 to an even-numbered floor 34 or from an even-numbered floor 34 to an odd-numbered floor 32 using an elevator.

In the running direction in which a double operation is performed, for each car, the floor to which an operation is prohibited is called an operation-prohibited floor. For example, in the case where an upper car stops only at even-numbered floors and a lower car stops only at the odd-numbered floors, an operation from even-numbered floors to odd-numbered floors is prohibited for the upper car. For this reason, the operation-prohibited floors for the upper car are each of the odd-numbered floors. Similarly, the operation-prohibited floors for the lower car are each of the even-numbered floors.

In the following, a concrete description will be given of the configuration of this group control system with reference to FIG. 1.

In FIG. 1, reference numeral 1 denotes a hall operating panel provided in a hall of an elevator. The hall operating panel 1 may be provided only in a prescribed hall or may be provided in each hall.

The hall operating panel 1 is a device by use of which an elevator user enters his or her destination floor in a hall. A destination floor refers to a floor at which a user wants to arrive finally. The hall operating panel 1 is provided with a numerical keypad 2, an indicator 3, an announcement device 4, a map storage device 5, an announcement storage device 6, destination floor storage means 7, determination means 8, and transient floor determination means 9.

The numerical keypad 2 constitutes an input device by use of which a user inputs information. The user inputs his or her destination floor by operating the numerical keypad 2. When a destination floor is inputted from the numerical keypad 2, the hall operating panel 1 sends information on the destination floor and information on a boarding floor (a floor on which the hall operating panel is installed) to a group control device 10, which will be described later.

Means other than the numerical keypad 2 may be provided in the hall operating panel 1 as an input device.

The indicator 3 and the announcement device 4 constitute a notification device for notifying users in a hall of prescribed information. Only one of the indicator 3 and the announcement device 4 may be provided in the hall operating panel 1 as a notification device. Also, means other than the indicator 3 and the announcement device 4 may be provided as a notification device in the hall operating panel 1.

Prescribed map information which the indicator 3 is caused to indicate is stored in the map storage device 5. Map information is information for guiding users from a hall of a floor to another floor (or to a hall of another floor) without using an elevator.

Prescribed voice information to be announced by the announcement device 4 is stored in the announcement storage device 6. Voice information corresponding to map information is also stored in the announcement storage device 6.

The destination floor storage means 7 is intended for storing a destination floor inputted by a user. When a user inputs a destination floor by operating the numerical keypad 2, information on the inputted destination floor is stored in the destination floor storage means 7.

The determination means 8 makes a determination as to whether or not a destination floor inputted by a user coincides with a service floor registered by the group control device 10 (a service floor of an assigned car). The determination means 8 makes the determination by comparing the destination floor information stored in the destination floor storage means 7 with the service floor information received from the group control device 10. The determination means 8 controls various kinds of actions according to the determination results.

The function of the transient floor determination means 9 will be described later.

The group control device 10 controls the operation of the whole system on the basis of information inputted from the hall operating panel 1 and the like. The group control device 10 is provided with determination means 11, upper and lower car assignment means 12, service floor changing means 13, call obtaining means 14, and transient floor determination means 15.

The determination means 11 makes a determination as to whether or not a user who inputted a destination floor from the hall operating panel 1 can move directly from a boarding floor to the destination floor using an elevator. The determination means 11 makes the determination on the basis of operation modes (a double operation and a semi-double operation) and information (boarding floor information and destination floor information) received from the hall operating panel 1. For example, in the case where a user inputted an operation-prohibited floor of a car stopping at a boarding floor (an upper car or a lower car) as a destination floor, the determination means 11 makes a determination to the effect that moving by an elevator is impossible (moving is impossible).

The upper and lower car assignment means 12 creates assigned car information and upper or lower car information which are necessary for an operation. The upper and lower car assignment means 12 creates the above-described information on the basis of, for example, determination results of the determination means 11, operational efficiency, and information received from the hall operating panel 1.

The service floor changing means 13 changes a service floor of a car according to determination results of the determination means 11. Usually, a service floor of a car is set as a destination floor of a user. In the case where the determination means 11 determines that moving is impossible, the service floor changing means 13 changes a service floor of a car to a floor preceding a destination floor of a user or a floor beyond a destination floor of a user. "A floor preceding a destination floor" refers to a floor immediately preceding a destination floor with respect to a running direction (the direction from a boarding floor to a destination floor (a service floor)). "A floor beyond a destination floor" refers to a floor immediately beyond a destination floor with respect to a running direction. For example, in the case where a car ascends, a floor immediately under a destination floor corresponds to "a floor preceding a destination floor" and a floor immediately above a destination floor corresponds to "a floor beyond a destination floor." In the case where a car descends, a floor immediately above a destination floor corresponds to "a floor preceding a destination floor" and a floor immediately under a destination floor corresponds to "a floor beyond a destination floor."

After a change of a service floor is made by the service floor changing means 13, the group control device 10 registers a floor after the change as a service floor of a car (an assigned car). In the case where the determination means 11 determines that moving is possible and a change of a service floor by the service floor changing means 13 is not made, the group control device 10 registers a destination floor of a user as a service floor of a car.

After registering a service floor, the group control device 10 sends various kinds of information including service floor information to the hall operating panel 1 and a car control device 16.

Each of the functions of the call obtaining means 14 and the transient floor determination means 15 will be described later.

The car control device 16 controls actions of a car device 17 provided with an upper car and a lower car. The car control device 16 controls actions of the car device 17 on the basis of information received from the group control device 10. The car control device 16 is provided with a map storage device 18, an announcement storage device 19, and a determination means 20. In the car device 17, an indicator 21 and an announcement device 22 are provided for each of the upper car and the lower car.

Prescribed map information which the indicator 21 is caused to indicate is stored in the map storage device 18. Prescribed voice information to be announced by the announcement device 22 is stored in the announcement storage device 19. Voice information corresponding to map information is also stored in the announcement storage device 19.

The determination means 20 makes a determination as to whether or not a destination floor inputted by a user coincides with a service floor registered by the group control device 10 (a service floor of an assigned car). The determination means 20 makes the determination on the basis of, for example, whether or not a change of a service floor was made by the service floor changing means 13. The determination means 20 controls various kinds of actions according to the determination results.

Figure 2:
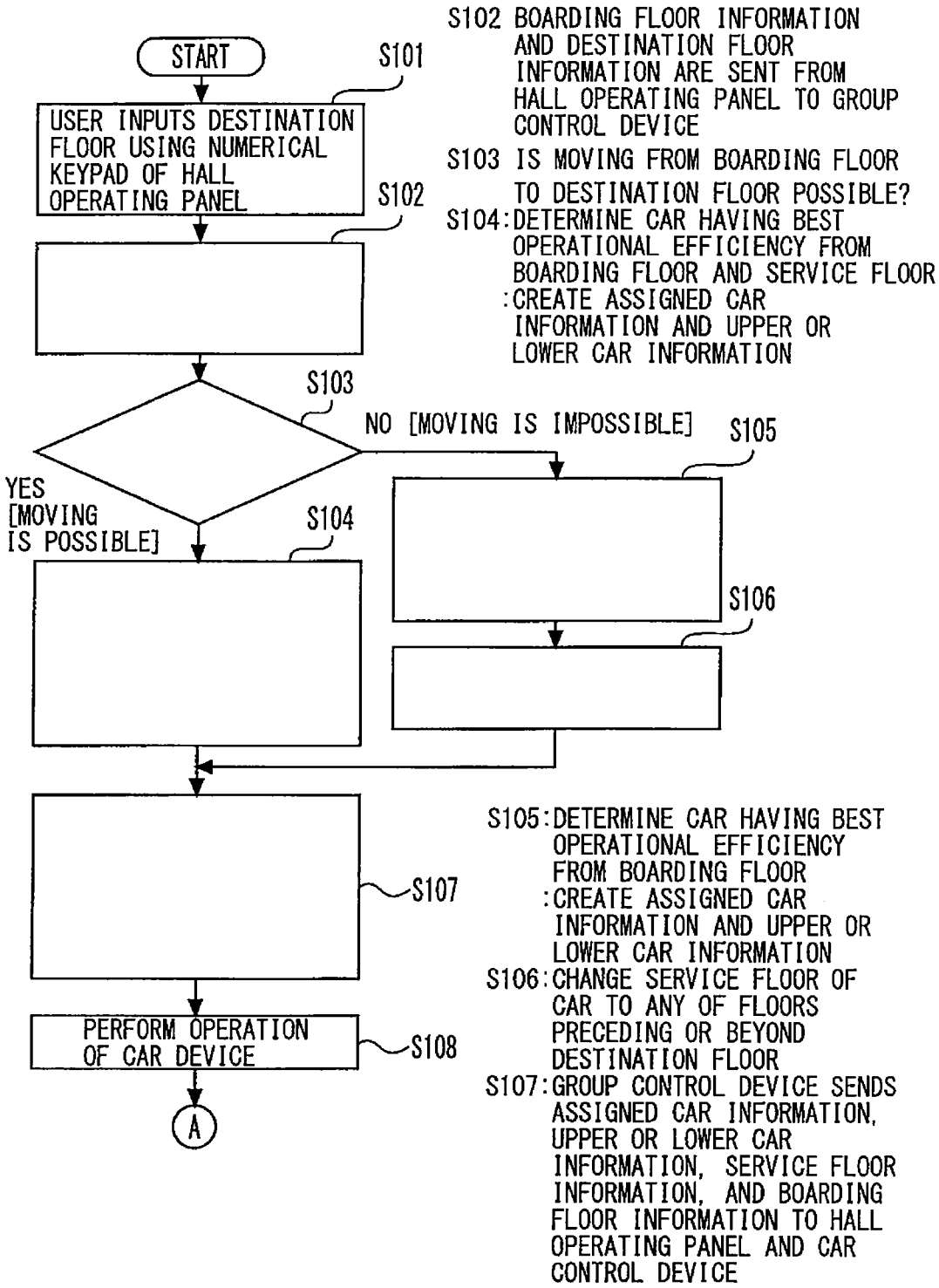
FIG. 2 is a flowchart showing actions of the elevator group control system in the first embodiment according to the present invention.

Next, referring also FIGS. 2 and 3, a description will be given of actions of the group control system having the above-described configuration. FIGS. 2 and 3 are flowcharts showing actions of the elevator group control system in the first embodiment according to the present invention.

When a user of an elevator inputs a destination floor using the numerical keypad 2 of the hall operating panel 1 (S101), boarding floor information and destination floor information are sent from the hall operating panel 1 to the group control device 10 (S102). For example, when a user pushes the button "4" in the hall operating panel 1 installed in the hall of the 1st floor, "the 1st floor" as boarding floor information and "the 4th floor" as destination floor information are sent to the group control device 10.

In the hall operating panel 1, information on the destination floor inputted by the user (the 4th floor) is stored in the destination floor storage means 7.

In the group control device 10, the determination means 11 makes a determination as to whether or not the user can move directly to the destination floor using an elevator (S103). For example, in the case where a semi-double operation is performed in an upward-direction traffic flow, the user can move from the 1st floor to the 4th floor by an elevator (Yes in S103). In this case, the upper and lower car assignment means 12 sets the destination floor inputted by the user as a service floor of a car and determines a car having the best operational efficiency from information on the boarding floor (the 1st floor) and the destination floor (the 4th floor). The upper and lower car assignment means 12 creates assigned car information and upper or lower car information (S104).

On the other hand, in the case where a double operation is performed in an upward-direction traffic flow, a user cannot move directly from the 1st floor to the 4th floor (No in S103). In this case, the upper and lower car assignment means 12 determines a car having the best operational efficiency from information on the boarding floor (the 1st floor) and creates assigned car information and upper or lower car information (S105). Also, the service floor changing means 13 changes the service floor of the car to any of floors (the 5th floor (or the 3rd floor)) preceding or beyond the initial service floor (the destination floor of the user (the 4th floor)) (S106).

When the processing in S104 or S106 is finished, the group control device 10 sends assigned car information, upper or lower car information, service floor information, and boarding floor information to the hall operating panel 1 and the car control device 16 (S107).

Upon receipt of the above-described information from the group control device 10, the car control device 16 appropriately performs the operation of the car device 17 provided with the upper and lower cars in accordance with the received information (S108). That is, the car control device 16 appropriately controls the car device 17 and causes an assigned car to respond to a hall call and a car call.

On the other hand, in the hall operating panel 1, upon receipt of the above-described information from the group control device 10, the determination means 8 compares the destination floor information stored in the destination floor storage means 7 with the service floor information received from the group control device 10 (S109). In the case where in the group control device 10 the processing of S104 was performed, the above-described destination floor information and service floor information coincide with each other (Yes in S109). In this case, the determination means 8 causes the indicator 3 to indicate each kind of information on the service floor (the destination floor), the assigned car, and the upper or lower car (S110).

In contrast to this, in the case where in the group control device 10 the processing of S106 was performed, the destination floor information and the service floor information do not coincide with each other (No in S109). In this case, the determination means 8 causes the indicator 3 to indicate each kind of information on the service floor, the assigned car, and the upper or lower car. Also, on the basis of the destination floor information stored in the destination floor storage means 7 (the 4th floor in the above-described example) and the service floor information received from the group control device 10 (the 5th floor in the above-described example), the determination means 8 extracts map information for guiding the user from the service floor of the car (the 5th floor) to the destination floor of the user (the 4th floor) from the map storage device 5 and causes the indicator 3 to indicate the map information (S111). Furthermore, the determination means 8 extracts voice information corresponding to the extracted map information from the announcement storage device 6 and causes the announcement device 4 to announce the voice information (S112).

After that, the car device 17 is appropriately controlled by the car control device 16, whereby the user boards the car from the boarding floor and moves to the service floor (S113). In the case where in the group control device 10 the processing of S104 was performed, the service floor of the car and the destination floor of the user coincide with each other and, therefore, the user can arrive at the destination floor by getting out of the car (Yes in S114).

On the other hand, in the case where the user inputted an operation-prohibited floor of the car as a destination floor from the hall operating panel 1, the user cannot arrive at the destination floor by simply getting off of the car (No in S114). However, the user has already been informed of the method of moving from the floor at which the user gets out of the car (the service floor of the car) to the destination floor. For this reason, on getting out of the car, the user moves to the destination floor in accordance with the indication contents of the indicator 3 and the contents of the announcement from the announcement device 4 (S115).

With the group control system of the above-described configuration, in the case where a user inputted an operation-prohibited floor of the car from the hall operating panel 1 as a destination floor, it is possible to quickly carry the user to a floor adjacent to the destination floor and furthermore, it is possible to provide information regarding the moving after getting out of the car to the user, before the user arrives at the service floor. For this reason, the user can arrive at the destination floor without getting lost and it is possible to substantially shorten the time required to arrive at the destination floor.

In this group control system, it is also possible to provide information to users through the use of notification devices (the indicator 21, the announcement device 22) provided in an assigned car.

Referring to also FIG. 4, these functions will be described below.

FIG. 4 is a flowchart showing other actions of the elevator group control system in the first embodiment according to the present invention. The processing flow shown in FIG. 4, for example, is carried out in parallel with the processing flow shown in FIGS. 2 and 3.

In the case where information is provided to users in a car, in S107 described above, the group control device 10 sends service floor information before a change by the service floor changing means 13 (which coincides with destination floor information) to the car control device 16 in addition to assigned car information, upper or lower car information, service floor information, and boarding floor information (S116).

Upon receipt of the information from the group control device 10, the car control device 16 appropriately performs the operation of the car device 17 in accordance with the received information (S117). That is, the car control device 16 appropriately controls the car device 17 and causes an assigned car to respond to a hall call and a car call.

In the car control device 16, upon receipt of the information from the group control device 10, the determination means 20 compares the service floor information before and after a change. In the case where a change of a service floor by the service floor changing means 13 was not made, the determination means 20 finishes the processing.

On the other hand, in the case where the user inputted an operation-prohibited floor of the car as a destination floor from the hall operating panel 1, coincidence does not occur in the service floor information before and after a change. In this case, on the basis of service floor information before and after a change (the 4th floor and the 5th floor in the above-described example), the determination means 20 extracts map information for guiding the user from the service floor of the car (the 5th floor) to the destination floor of the user (the 4th floor) from the map storage device 18. Also, the determination means 20 extracts voice information corresponding to the extracted map information from the announcement storage device 19 (S118).

When it is decided that an assigned car arrives at a service floor, the determination means 20 causes the indicator 21 of the car to indicate the extracted map information (S119). Also, the determination means 20 causes the announcement device 22 to announce corresponding voice information (S120). As a result of this, the user can ascertain the method of moving from the service floor to the destination floor even when the user is present in the car moving to the service floor.

Second Embodiment

In this embodiment, a description will be given of the case where the service floor changing means 13 changes a service floor of a car according to the registration condition of a call when a user inputted an operation-prohibited floor of the car as a destination floor from the hall operating panel 1.

The call obtaining means 14 performs the detection of the registration condition of a call. After obtaining registration information of a call, the call obtaining means 14 sends the registration information to the service floor changing means 13. The service floor changing means 13 makes a change of a service floor in consideration of also the registration information of a call received from the call obtaining means 14.

In the following, referring to also FIGS. 5 and 6, a description will be given of actions of the group control system having the above-described functions. FIGS. 5 and 6 are flowcharts showing actions of the elevator group control system in the second embodiment according to the present invention.

Actions shown in S201 to S205 are the same as the actions shown in S101 to S105.

When a user inputs an operation-prohibited floor of a car as a destination floor from the hall operating panel 1 and in S203 it is determined that the moving is impossible, the call obtaining means 14 detects the registration condition of a call of an assigned car. The service floor changing means 13 obtains the registration information of a call of an assigned car from the call obtaining means 14 (S206).

The service floor changing means 13 makes a determination as to whether or not a call (a hall call, a car call) has already been registered for floors preceding or beyond the destination floor of the user on the basis of information received from the call obtaining means 14 (S207).

In the case where a call has been registered for only either of the floors preceding or beyond the destination floor, the service floor changing means 13 changes the service floor of the car to a floor for which the call has been registered. For example, in the above-described example in which the user inputted the 4th floor from the hall operating panel 1 of the 1st floor, if a call has been registered only for the floor (the 5th floor) beyond the destination floor (the 4th floor), the service floor changing means 13 changes the service floor of the car to the floor (the 5th floor) beyond the destination floor (S208). In the case where a call has been registered only for the floor (the 3rd floor) preceding the destination floor (the 4th floor), the service floor changing means 13 changes the service floor of the car to the floor (the 3 rd floor) preceding the destination floor (S209).

On the other hand, in the case where the registration conditions of calls for the floors preceding and beyond the destination floor are the same, the service floor changing means 13 changes the service floor of the car to a floor higher than the destination floor (S210). For example, in the above-described example in which the user inputted the 4th floor from the hall operating panel 1 of the 1st floor, if calls have been registered for both the floor (the 3rd floor) preceding the destination floor (the 4th floor) and the floor (the 5th floor) beyond the destination floor, the service floor changing means 13 changes the service floor of the car to the floor (the 5th floor) beyond the destination floor. Similarly, even in the case where a call has not been registered for either the floor (the 3rd floor) preceding the destination floor (the 4th floor) or the floor (the 5th floor) beyond the destination floor, the service floor changing means 13 changes the service floor of the car to the floor (the 5th floor) beyond the destination floor.

In the case where a service floor is changed by the service floor changing means 13, the group control device 10 registers the changed floor as a service floor of a car (an assigned car).

Actions shown in S211 to S219 are the same as the actions shown in S107 to S115.

In parallel with the processing flow shown in FIGS. 5 and 6, the processing flow shown in FIG. 4 may be carried out.

With the group control system of the above-described configuration, in the case where a user inputted an operation-prohibited floor of the car as a destination floor from the hall operating panel 1, it is possible to appropriately set a service floor of the car according to the registration condition of calls for floors preceding and beyond the destination floor. In the case where the registration conditions of calls of the floors preceding and beyond the destination floor are the same, the service floor of the car is changed to a floor immediately above the destination floor. Many users feel that moving to lower floors is easier than moving to upper floors and, therefore, with this group control system, it is possible to reduce the burden of users after getting out of the car.

Third Embodiment

In this embodiment, a description will be given of the case where a double operation is performed in one running direction and a semi-double operation is performed in the other running direction (the reverse running direction). In a semi-double operation, the upper car stops at both odd-numbered floors and even-numbered floors. Also the lower car stops at both odd-numbered floors and even-numbered floors. In the case where a semi-double operation is performed, a user can move directly from any floor to any floor (with the exception where a user moves from one terminal floor to the other terminal floor).

In this embodiment, the group control device 10 does not use the function of the service floor changing means 13. Upon receipt of boarding floor information and destination floor information from the hall operating panel 1, the group control device 10 registers a destination floor of a user as a service floor of a car. However, in the case where a user inputs an operation-prohibited floor of a car as a destination floor from the hall operating panel 1, it is impossible to carry the user directly from the boarding floor to the destination floor by an elevator. In this case, the group control device 10 registers a transient floor by the function of the transient floor determination means 15.

The transient floor determination means 15 determines a floor (a transient floor) to which the car is moved before being stopped at a service floor. The transient floor determination means 15 determines a transient floor in consideration of also determination results of the determination means 11 and call registration information received from the call obtaining means 14. The transient floor determination means 15 registers any floor beyond a service floor (a destination floor of a user) as a transient floor.

On the basis of information received from the group control device 10, the transient floor determination means 9 makes a determination as to whether or not there is (a registration of) a transient floor. The transient floor determination means 9 controls various kinds of actions according to the determination results.

Figure 8:
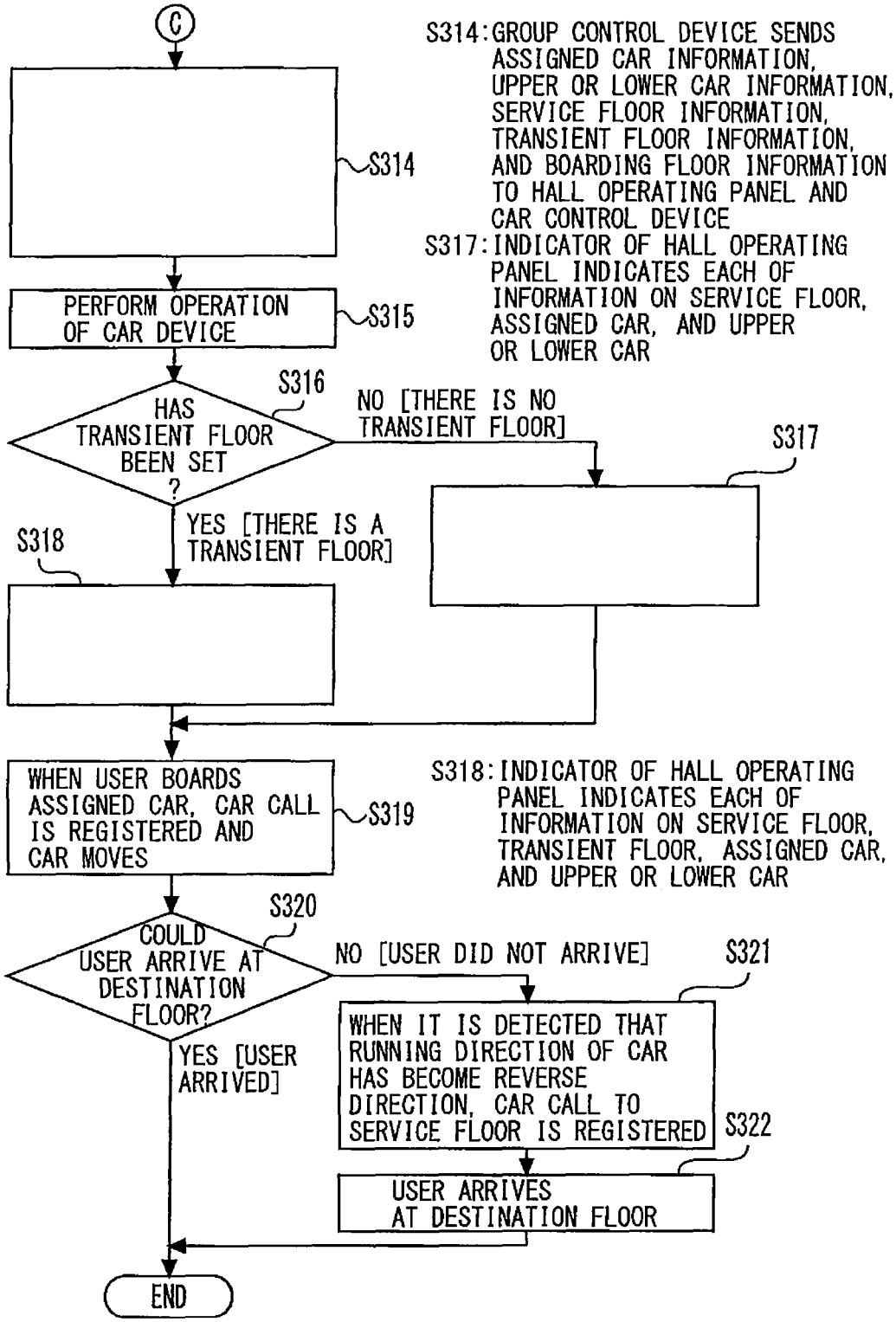
FIG. 8 is a flowchart showing actions of the elevator group control system in the third embodiment according to the present invention.

In the following, referring also FIGS. 7 and 8, a description will be given of actions of the group control system having the above-described functions. FIGS. 7 and 8 are flowcharts showing actions of the elevator group control system in the third embodiment according to the present invention.

In the following description, it is assumed that a prescribed running direction is set in a direction to be crowded (for example, according to the time division of the day).

The actions shown in S301 to S305 are the same as the actions shown in S201 to S205.

When a user inputs an operation-prohibited floor of the car as a destination floor from the hall operating panel 1 and it is determined in S303 that the moving is impossible, the transient floor determination means 15 obtains registration information on calls of an assigned car from the call obtaining means 14 (S306). The transient floor determination means 15 makes a determination as to whether or not the running direction taken when an assigned car arrives at the boarding floor (the direction from the boarding floor to the service floor (the destination floor)) coincides with the direction to be crowded (S307).

In the case where the running direction taken when the car arrives coincides with the direction to be crowded (Yes in S307), that is, in the case where the double operation is performed in the direction to be crowded, the transient floor determination means 15 makes a determination as to whether or not a call has already been registered for any of floors beyond the service floor (corresponding to the destination floor of the user) (S308). If there is a call to any of floors beyond the service floor (Yes in S308), the transient floor determination means 15 sets, as a transient floor, a floor most remote from the service floor among the floors for which a call has been registered (i.e., a floor nearest to the terminal floor on the side of the direction to be crowded) (S309). In the above-described example in which the user inputted the 4th floor from the hall operating panel 1 of the 1st floor, in the case where a double operation is performed in an upward-direction traffic flow, if a call has been registered each for the 5th floor, the 7th floor, and the 9th floor, then the transient floor determination means 15 sets the 9th floor, which is nearest to the terminal floor (for example, the 10th floor) in the upward direction as a transient floor.

On the other hand, in the case where a call has not been registered for any of floors beyond the service floor (No in S308), the transient floor determination means 15 sets a floor beyond the service floor (in the above-described example, the 5th floor) as a transient floor (S310).

In the case where the running direction taken when the car arrives does not coincide with the direction to be crowded (No in S307), the transient floor determination means 15 makes a determination as to whether or not a call has already been registered for any of floors beyond (on the side in the direction reverse to the direction to be crowded) the service floor (corresponding to the destination floor of the user) (S311). If there is a call to any of floors beyond the service floor (Yes in S311), the transient floor determination means 15 sets, as a transient floor, a floor most remote from the service floor (i.e., a floor nearest to the terminal floor on the side in the above-described reverse direction) among the floors for which a call has been registered (S312).

On the other hand, in the case where a call has not been registered for any of floors beyond the service floor (No in S311), the transient floor determination means 15 sets, as a transient floor, a floor at which the assigned car can operate (can stop) and which is nearest to the terminal floor on the side in the above-described reverse direction. If the assigned car can operate at a terminal floor beyond the service floor, the transient floor determination means 15 sets the terminal floor as a transient floor (S313).

When the processing of S304 or the above-described setting processing of a transient floor is finished, the group control device 10 sends assigned car information, upper or lower car information, service floor information, transient floor information, and boarding floor information to the hall operating panel 1 and the car control device 16 (S314).

Upon receipt of the information from the group control device 10, the car control device 16 appropriately performs the operation of the car device 17 provided with the upper car and the lower car in accordance with the received information (S315).

In the hall operating panel 1, upon receipt of the information from the group control device 10, the transient floor determination means 9 makes a determination as to whether or not the setting of a transient floor has been performed (S316). In the case where in the group control device 10 the processing of S304 has been performed, a transient floor has not been set (No in S316). In this case, the transient floor determination means 9 causes the indicator 3 to indicate each of information on the service floor (the destination floor), the assigned car, and the upper or lower car (S317).

On the other hand, in the case where the user inputted an operation-inhibited floor of the car as a destination floor from the hall operating panel 1, the determination of No is made in S303 and a transient floor is set (Yes in S316). In this case, the transient floor determination means 9 causes the indicator 3 to indicate each of information on the service floor, the transient floor, the assigned car, and the upper or lower car (S318).

When the assigned car stops at the boarding floor after the indication to the indicator 3 is performed and the user boards the car, the car control device 16 registers a car call (S319). Unless a transient floor has been set at this time, the car control device 16 registers a car call corresponding to the service floor and causes the moving of the car to be started. As a result of this, the car moves directly from the boarding floor to the service floor and the user can get out of the car at the destination floor (Yes in S320).

On the other hand, in the case where a transient floor has not been set, first, the car control device 16 registers a car call corresponding to the transient floor and causes the moving of the car to be started. In this case, the user cannot move directly from the boarding floor to the destination floor (No in S320). After moving the car from the boarding floor to the transient floor, the car control device 16 reverses the running direction of the car and registers a car call corresponding to the service floor (S321). As a result of this, the car starts moving from the transient floor toward the service floor. After that, the car control device 16 stops the car at the service floor and causes the user to get out of the car at the service floor (the destination floor of the user) (S322).

With the group control system of the above-described configuration, in the case where a double operation is performed in one running direction and a semi-double operation is performed in the other running direction, it is possible to rapidly carry a user to a destination floor.

In the group control system of the above-described configuration, information on a transient floor may be provided also using notification devices (the indicator 21, the announcement device 22) provided in an assigned car.

INDUSTRIAL APPLICABILITY

The group control system of elevators of the present invention can be applied to a group control system which controls the operation of a double-deck elevator.

REFERENCE SIGNS LIST

1 hall operating panel
2 numerical keypad

3, 21 indicator
4, 22 announcement device
5, 18 map storage device
6, 19 announcement storage device
7 destination floor storage means
8, 11, 20 determination means
9 transient floor determination means
10 group control device
12 upper and lower car assignment means
13 service floor changing means
14 call obtaining means
15 transient floor determination means
16 car control device
17 car device

The invention claimed is:

1. An elevator group control system which is provided with two cars vertically connected to each other and performs a double operation in a prescribed running direction, comprising:

a hall operating panel which is provided in a prescribed hall of an elevator and by use of which a user inputs a destination floor; and a group control device which, in the case where an operation-prohibited destination floor of one of said two cars stopping at the hall is inputted from the hall operating panel as a destination floor, determines whether a call has already been registered for a floor preceding or beyond the operation-prohibited destination floor, and when it is determined that a call has already been registered for a floor preceding or beyond the operation-prohibited destination floor, the group control device registers the floor for which the call has been registered as a service floor of the one of said two cars.

2. The elevator group control system according to claim 1, wherein when it is determined that a call has not already been registered for either a floor preceding the destination floor or a floor beyond the destination floor, the group control device registers a floor higher than the destination floor as a service floor of the car.

3. An elevator group control system which is provided with two cars vertically connected to each other and performs a double operation in a prescribed running direction, comprising:

a hall operating panel which is provided in a prescribed hall of an elevator and by use of which a user inputs a destination floor; and a group control device which, in the case where an operation-prohibited destination floor of one of said two cars stopping at the hall is inputted from the hall operating panel as a destination floor, determines whether a call has already been registered for both a floor preceding the destination floor and a floor beyond the operation-prohibited destination floor, and when it is determined that a call has already been registered for both a floor preceding the destination floor and a floor beyond the operation-prohibited destination floor, the group control device registers a floor higher than the destination floor as a service floor of the one of said two cars.

4. The elevator group control system according to claim 3, wherein when it is determined that a call has not already been registered for either a floor preceding the destination floor or a floor beyond the destination floor, the group control device registers a floor higher than the destination floor as a service floor of the car.

5. An elevator group control system which is provided with two cars vertically connected to each other and performs a double operation in one running direction and performs a semi-double operation in the other running direction, comprising:

a hall operating panel which is provided in a prescribed hall of an elevator and by use of which a user inputs a destination floor;

a group control device which, in the case where an operation-prohibited floor of a car stopping at the hall is inputted from the hall operating panel as a destination floor, registers the destination floor inputted from the hall operating panel as a service floor of the car and registers a prescribed floor beyond the service floor as a transient floor; and a car control device which, after the registration of the transient floor by the group control device, causes the car to move to the transient floor and thereafter causes the car to stop at the service floor.

6. The elevator group control system according to claim 5, wherein in the case where an operation-prohibited floor of a car stopping at the hall is inputted from the hall operating panel as a destination floor, if a call has already been registered for any of floors beyond the destination floor, the group control device registers, as a transient floor, a floor most remote from the destination floor among floors for which a call has been registered.

7. The elevator group control system according to claim 5, wherein in the case where an operation-prohibited floor of a car stopping at the hall is inputted from the hall operating panel as a destination floor, if no call has been registered for any of floors beyond the destination floor, the group control device registers a floor beyond the destination floor as a transient floor so long as a direction from a boarding floor to the destination floor coincides with a prescribed direction to be crowded.

8. The elevator group control system according to claim 5, wherein in the case where an operation-prohibited floor of a car stopping at the hall is inputted from the hall operating panel as a destination floor, if no call has been registered for any of floors beyond the destination floor, the group control device registers, as a transient floor, a floor nearest to a terminal floor beyond the destination floor among floors at which the car can operate unless a direction from a boarding floor to the destination floor coincides with a prescribed direction to be crowded.

* * * * *